United States Patent [19]

Salazar

[11] Patent Number: 4,802,649

[45] Date of Patent: Feb. 7, 1989

[54] APPARATUS FOR MAKING AN ADOBE BRICK STRUCTURE

[76] Inventor: Thomas D. Salazar, Rte. 9, Box 86DS, Sante Fe, N. Mex. 87505

[21] Appl. No.: 86,480

[22] Filed: Aug. 18, 1987

[51] Int. Cl.[4] ..... B28B 7/02; E04G 11/20

[52] U.S. Cl. ..... 249/21; 249/120; 249/129; 249/158; 249/161; 264/33

[58] Field of Search ..... 249/2-8, 249/13, 14, 19, 20, 21, 33, 34, 117, 119, 120, 129, 155, 157, 158, 161; 220/94 A; 264/33

[56] References Cited

U.S. PATENT DOCUMENTS

| | | | |
|---|---|---|---|
| 213,371 | 3/1879 | Allen et al. | 249/115 |
| 434,221 | 8/1890 | Whittaker | 249/139 |
| 733,396 | 7/1903 | Jarvis | 249/9 |
| 778,583 | 12/1904 | Jarvis | 249/44 |
| 779,319 | 1/1905 | Russell | 249/49 |
| 805,457 | 11/1905 | Francisco | 249/137 |
| 915,556 | 3/1909 | Coon | 249/171 |
| 955,282 | 4/1910 | Pocock | 249/158 |
| 1,675,443 | 7/1928 | Bell | 249/158 |
| 2,190,801 | 2/1940 | Otto | 249/14 |
| 2,610,380 | 9/1952 | Pollman | 249/34 |
| 3,827,666 | 8/1974 | Dreher | 249/18 |
| 3,897,927 | 8/1975 | Muller | 249/20 |
| 4,210,304 | 7/1980 | Mannina | 249/22 |
| 4,451,022 | 5/1984 | Sauger | 249/158 |

*Primary Examiner*—Jay H. Woo
*Assistant Examiner*—James C. Housel

[57] ABSTRACT

A rectangular shaped device for making abode bricks including an L-shaped rod mounted perpendicularly to the rectangular shaped device to provide stability and a T-shaped planar insert having a means for adjusting so that different size abode bricks can be made. The form is used at the desired position to make an adobe brick of the adobe structure. The setting of the rectangular shaped device next to the just previously formed adobe brick leaves a gap. The gap is filled when an adobe brick is formed above the gap. Also, the form is combined with a plurality of forms to make a gang mold. The gang mold is used to make a course of adobe bricks. This method of on site adobe brick building forms an uniform integrated adobe structure.

14 Claims, 6 Drawing Sheets

APPARATUS FOR MAKING AN ADOBE BRICK STRUCTURE

BACKGROUND OF THE INVENTION

The present invention generally relates to adobe construction using a form which differs radically from all other adobe construction techniques.

The other techniques utilize pre-cast and dried adobe bricks laid up in courses with a bed of mud between them. This is similar to the traditional method of laying bricks. A great deal of time and energy as well as much breakage is involved in making these pre-cast adobes, which then remain separate entities held together only by a mud mortar.

SUMMARY OF THE INVENTION

The present invention, on the other hand, casts the adobes in place on the wall without mortar, at a very great saving of time and labor. The result is a much stronger and more cohesive wall. The present invention further includes an unique feature of adjustability so that adobe bricks of varying sizes can be easily poured. This feature in particular distinguishes the present invention from all other forms which have been used hitherto in adobe construction.

An object of the present invention is to provide a rectangular shaped device defining a hollow volume for receiving adobe mud. The device or form includes two pairs of planar sides. Each of said pairs of planar sides has an inside face and an outside face. The rectangular device further includes a first planar edge which extends around the top perimeter of the rectangular shaped device and a second planar edge which extends around the bottom perimeter.

Another object of the present invention is to provide a handhold which forms a cavity on the outside face of each of the planar sides. The handhold is for maneuvering said rectangular shaped device.

Another object of the present invention is to provide a means for adjusting the rectangular shaped device. The adjusting means includes a T-shaped planar insert having a rod integrally protruding perpendicularly from the T-shaped planar insert. Also, there is a sleeve member which has an opening at one end and the other end terminates into a base. There, also, is a clamping means used for clamping the rod to the sleeve so that the T-shaped planar insert is fixedly supported.

An object of the invention is to provide a plurality of rectangular shaped devices connected to make a gang mold.

Another object of the invention is to provide a means for adjusting the gang mold. The adjusting means includes a T-shaped planar insert having a rod integrally protruding perpendicularly from the T-shaped planar insert. Also, there is a clamping means used for clamping the rod to the gang mold so that the T-shaped planar insert is fixedly supported.

It is a feature of this invention to have a rectangular shaped form with an adjustable insert and a stablizing rod which provide adjustability to make different shaped bricks and stability to make bricks at window and door openings.

It is another feature of this invention to have a plurality of rectangular shaped forms connected together to make a gang mold with an adjustable insert which provides adjustability to make different shaped bricks in a course of adobe bricks.

It is an advantage of this invention that the form or gang mold can be pulled immediately as opposed to concrete which requires the mold to be left in place to set at least for a couple of hours. This invention is unique to "mud" only and cannot be used for concrete.

It is another advantage of the invention that the gang mold can construct a wall of bricks in a relatively short time.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIGS. 3(*a*) and (*b*) show side views of the spacers;

BRIEF DESCRIPTION OF THE PREFERRED EMBODIMENT

Figure 1:
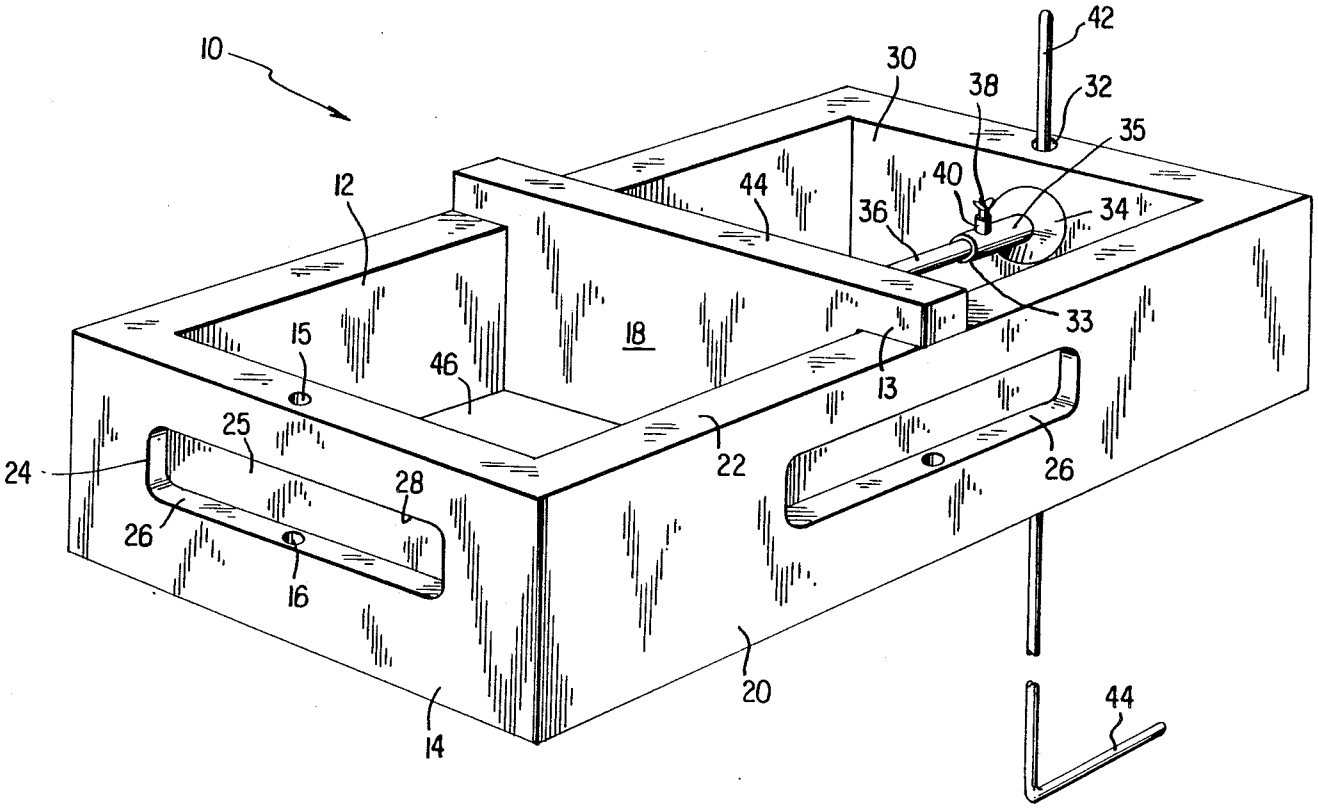
FIG. 1 shows a form of a preferred embodiment of the invention.

Referred now specifically to the drawings, FIG. 1 shows the form 10 as a four-sided rectangular box. The form 10 is constructed of plastic or any other suitable material. The form 10 has sides 12 and 20 which have inside dimensions of 15½ inches in length by 4 inches in height. The other sides 14 and 30 of the form 10 have inside dimensions of 10 inches in length by 4 inches in height. The top edge 22 of the form 10 is one inch thick. The form 10 may be used to build adobe walls either 15½ inches or 10 inches thick.

Each of the sides 12, 14, 20 and 30 of the form 10 have an indentation or cavity of approximately 6 inches × 2½ inches, which serve as a handhold 25. The handholds are approximately ¾ of an inch thick measured from the outside edge 24. Therefore, the inside of the form 10 is smooth.

Each wall 12, 14, 20 and 30 is pierced vertically through the center by a ¼ inch hole 15. The hole or through aperture 15 pierces the top edge 22 of the form 10 and extends through the top edge 28 of the handhold 25 as shown in FIG. 1. Coaxially aligned with hole 15 is another hole 16 which continues through the handhold at the bottom 26 and protrudes through the bottom edge of side 14. Therefore, through the center of each of the sides 12, 14, 20 and 30, there is a ¼ inch hole.

The holes are designed to accommodate a steel rod 42 which acts as a leg to support the form 10 when the form 10 is used to make half-bricks at door and window openings. The steel rod is L-shaped. Thus, the rod at the bottom forms a foot 44.

The form or box 10 is equipped with two removable T-shaped inserts or spacers 18 and 19. Insert 18 is 9½ inches×4 inches and is used in constructing a 10 inch thick adobe wall. The other insert 19 is 15¼ inches×4 inches and is for constructing a 15½ inch wall. The inserts 18 and 19 make it possible to pour half-bricks at window and door openings.

Depending upon the size of the desired brick, one or the other insert 18 or 19 is placed in the form 10 and secured by means of a rod 36 which slides into a sleeve 35 fitted with a wing nut 38.

Figures 2, 3A, 3B:
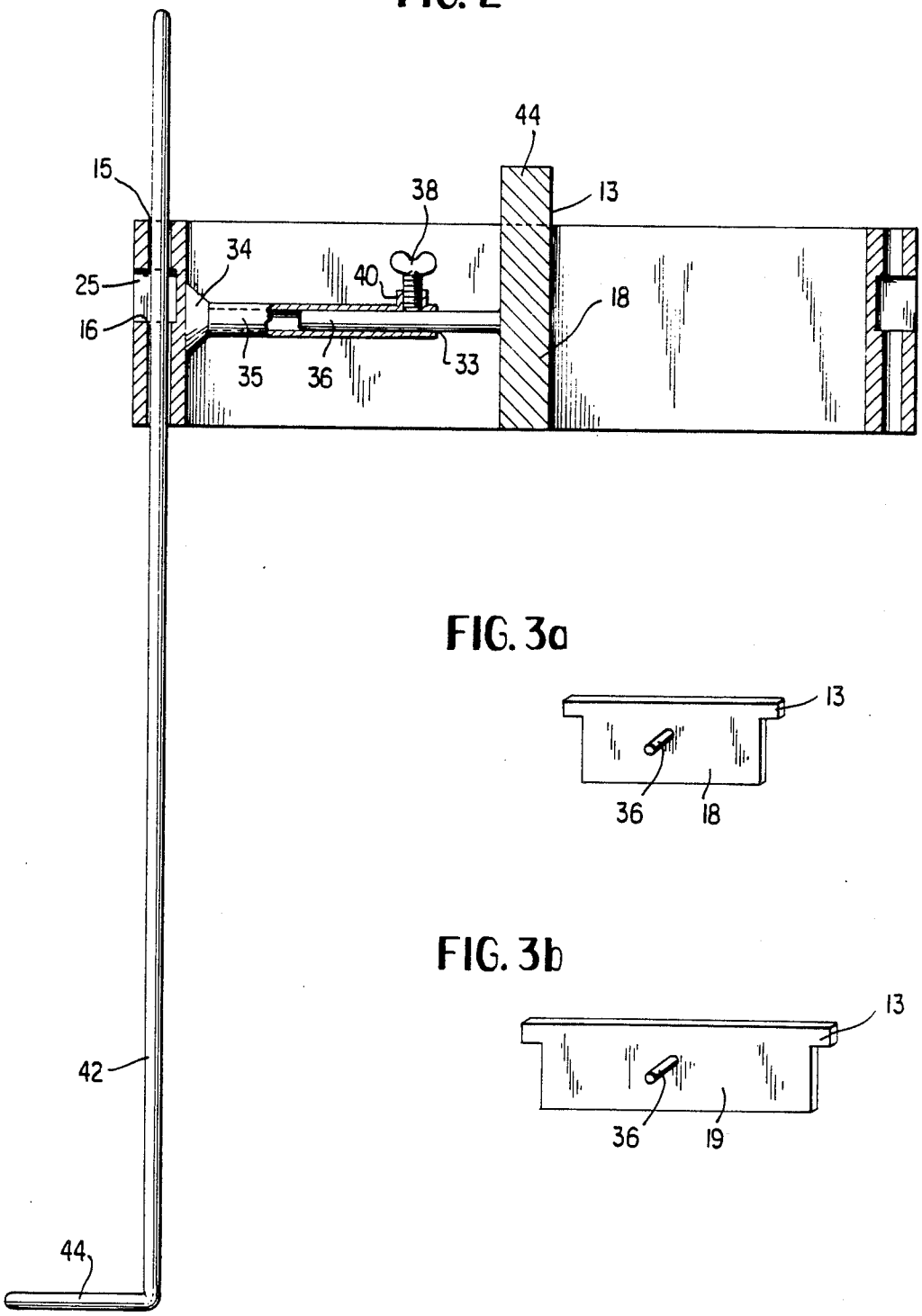
FIG. 2 shows a sectional view of the form, adjusting means, and stabilizing rod.

FIG. 2 shows the sectional view of the form 10, rod 42, and the sleeve 35. As shown in the figure, the insert 18 has a rod 36 as an integral part of the insert 18 and connected perpendicular to the insert 18. Since the preferred material is plastic, then rod 36 and insert 18 are formed as one piece. The rod 36 slides into the tubular telescoping sleeve 35. This adjustable connection determines the size of the brick since the adjustment is changed along the length of the rod 36.

The telescoping sleeve 35 in combination with rod 36 provides adjustability to accommodate varying sizes of adobe bricks. The sleeve 35 has a female threaded nipple 40 welded perpendicular to the sleeve 35 and opening 33. A wingnut 38 or some other clamping device is screwed into the female nipple 40 to clamp the rod 36 into a secured position. With the rod 36 secured, the insert 18 is in position to make the desired size of the adobe brick.

At the opposite end of the opening 33, there is a partial conical or frustrum shaped member 34 connected to the telescoping sleeve 35. Because the preferred material is plastic then member 34 is formed or molded as part of sleeve 35. Member 34 acts as a base for sleeve 35 and keeps inserts 18 perpendicular to the sides 12 and 20 and equi-distance from side 14. The member 34 is not connected to the form 10. Instead, the member 34 is held to the side 30 of form 10 by friction, initially, and by lateral pressure from the mud poured into the form 10. Member 34 can be hand held until a small amount of adobe mud is placed in the form 10, then external pressure on insert 18 prevents movement.

As shown in FIGS. 3(*a*) and (*b*), the inserts 18 and 19 are relatively the same T-shape. Insert 18 has bottom or base dimension of 9¾ inches in length and top dimension of 11¾ inches in length. The overhangs 13, at the top of the insert, have the dimensions of one inch by one inch by one inch. The total height of insert 18 is 5 inches and the thickness is one inch. The insert fits securely inside the form 10 with the overhangs 13 resting of the top edge 22 of the form 10. Mounted in the center of the insert is rod 36 which is used to secure the insert to a desired position to make the adobe brick.

FIG. 3(*b*) shows insert 19 which has the bottom or base dimension of 15¼ inches in length and the top dimension 17½ inches in length. The overhangs 13 are the same size for both inserts as is the thickness.

Figure 4A:
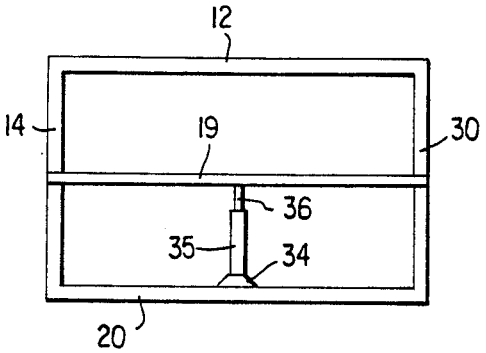
FIGS. 4(*a*) and (*b*) show different size adjusting means.
Figure 4B:
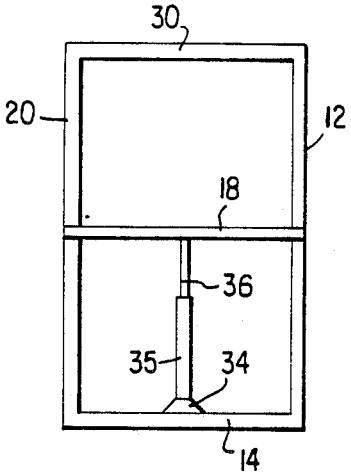

FIGS. 4(*a*) and 4(*b*) show different embodiments of the inserts 18 and 19. FIG. 4(*a*) shows that insert 19 can have a rod 36 of 3 inches in length. Also, the figure shows that the telescoping sleeve 35 can be 3 inches in length. FIG. 4(*b*) shows insert 18 with a rod 36 of 4 inches in length and sleeve 35 being 5 inches. Thus, anyone using the form 10 could adjust the form 10 by using the adjusting means to any desired size depending on the needed adobe brick sizes.

Figure 5A:
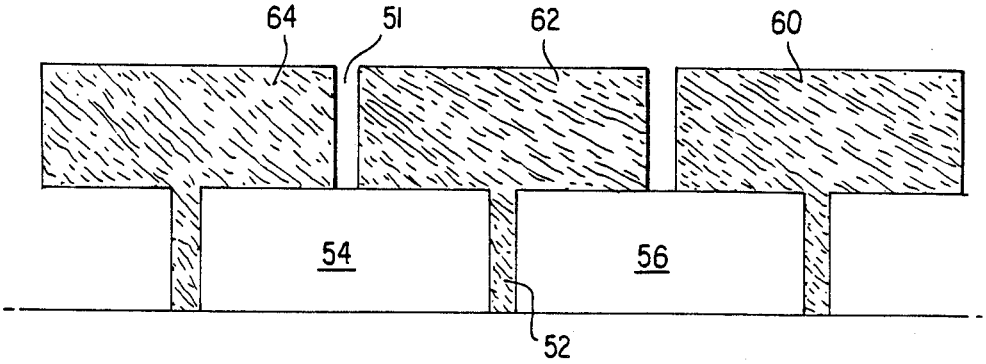
FIGS. 5(*a*) and (*b*) show a side view of the adobe bricks after the form has been removed.
Figure 5B:
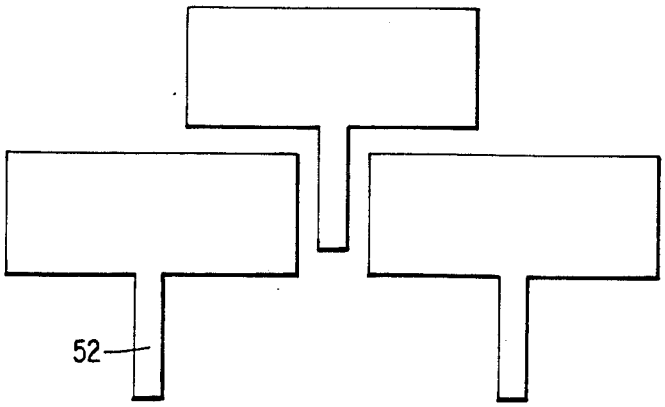

FIGS. 5(*a*) and (*b*) show the adobe bricks formed by the form 10. The form 10 is set in place on the stem wall or on the previous course of adobe bricks. Adobe mud is mixed in the correct proportions of clay dirt and water and is trowelled into the form 10. The form 10 is then removed, leaving a perfectly formed adobe brick 54. The form 10 is moved to the immediately adjacent location in the wall, where the process is repeated. The thickness of the wall of the form 10 leaves a ¾ inch to 1 inch slot or "gap" 52 between the bricks 54 and 56 which will be filled in when the next course of bricks 60, 62 and 64 are casted. The filled in gap is generally indicated by 52. The result is a wall of perfectly uniform adobes which, when dry, create an integrated structure. Because each course of bricks is freshly cast upon the preceding course of adobe bricks, the course of adobe bricks assume the characteristics of the adobes below, including the gap or slot 52 between the adobes, thus tying the higher bricks into the bricks below.

Figure 6A:
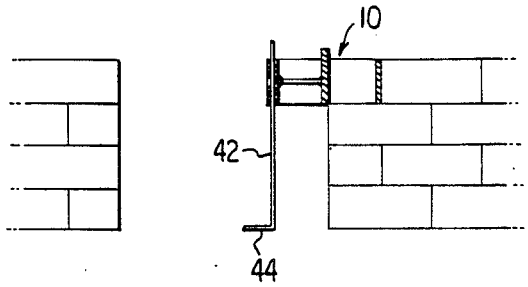
FIGS. 6(*a*) and (*b*) show the form being used at the end of a wall to form a doorway.
Figure 6B:
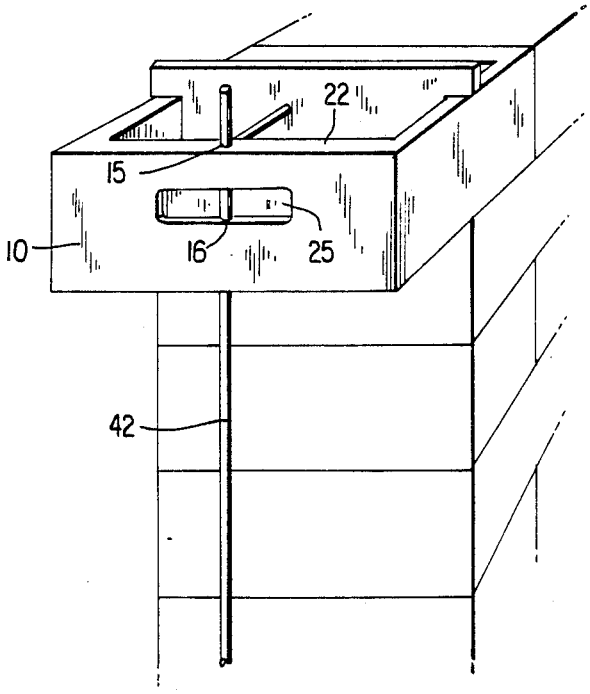

FIGS. 6(*a*) and (*b*) show the form 10 being used at door and window openings where it is necessary to construct half-bricks. Using one of the inserts 18 or 19 to adjust the form 10 to the desired size of adobe brick, the rod 42 and its foot 44 keep the form 10 stable on a horizontal plane. The rod 42 is adjustable to any length, the length being dependent on the height of the brick placement. As shown in FIG. 6(*b*), the rod 42 extends through the bottom of the side, through the handhold 25 and out the top edge 22 of the form 10. Because the rod 42 is approximately the same diameter as the hole, any movement of the form 10 will be stabilized or supported by the rod 42.

Figure 7:
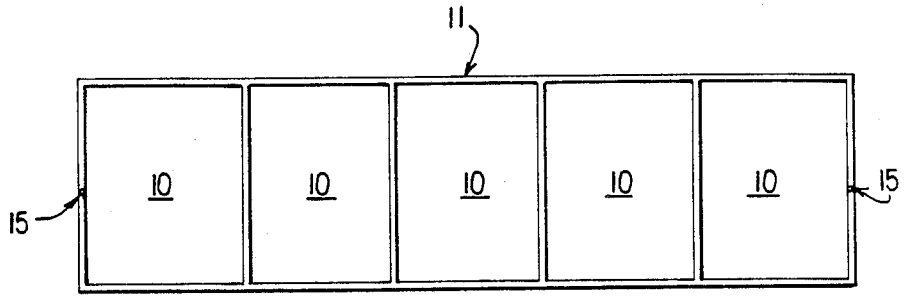
FIG. 7 shows a top view of a gang mold of a preferred embodiment.

Referring to FIG. 7, the gang mold 11 is shown. The gang mold 11 is comprised of at least two forms 10 connected together. The number of forms used depends on the size of the wall to be casted. This combination of the plurality of forms 10 into a gang mold 11 allows the builder to construct a wall in relatively short period of time. The stabilizing rod 42 can be inserted in the holes 15 is stabilization is necessary. Also, the insert 18 or 19 along with the telescoping sleeve can be used in one or any combination up to and including all of the forms 10 of the gang mold 11.

Figure 11:
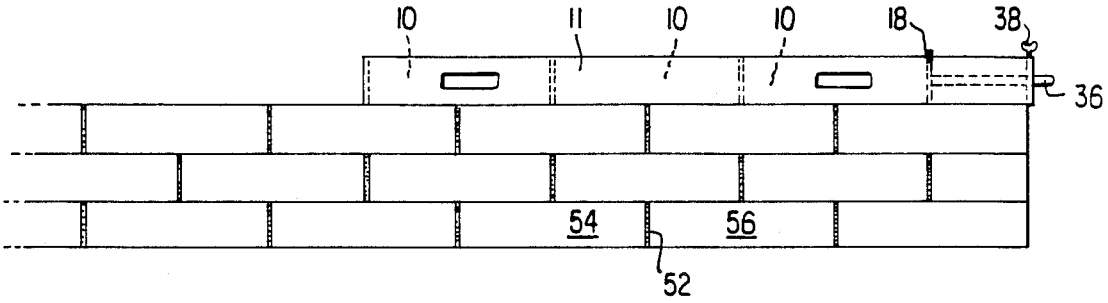
FIG. 11 shows an adobe wall made with the gang mold and another embodiment for the adjusting means.
Figure 12:
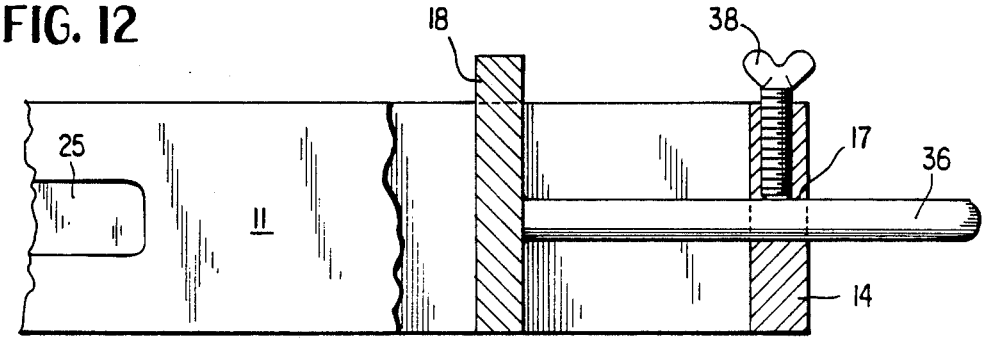
FIG. 12 shows a sectional view of the insert and the adjusting means.
Figure 13:
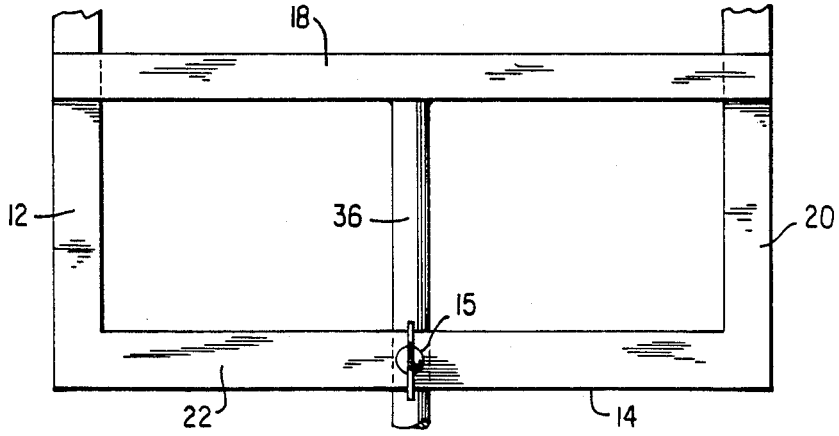
FIG. 13 shows a top view of the insert and adjusting means.
Figure 14:
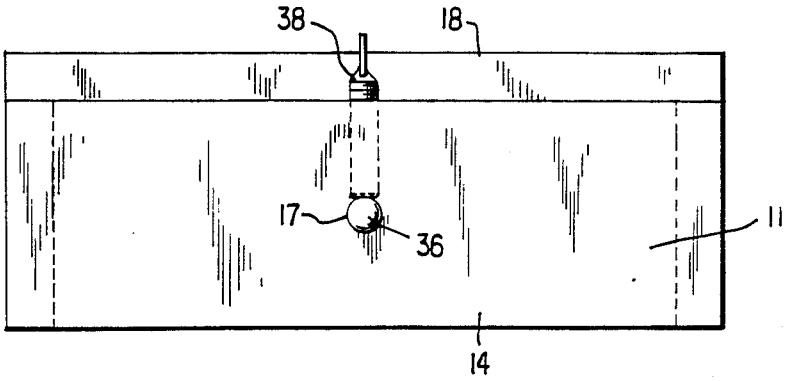
FIG. 14 shows a side view of the gang mold.

FIGS. 11–14 refer to another embodiment of the gang mold 11. FIG. 11 shows the gang mold 11 being used to cast a course of adobe bricks. In this embodiment, the stabilizing rod 42 is not used. Instead, the wall provides a cantilevering effect to balance or support the gang mold 11.

Also, as shown in the figures, the telescoping sleeve 35 and partial conical or frustum shaped member 34 is not needed. In this embodiment, the side 14 of the gang mold has a hole 17 or through aperture drilled perpendicular to the insert 18. The hole 17 supports the rod 36. The top edge 22, which in the single form 10 supported the steel rod 42, now is used to hold the set screw 38. The set screw 38 clamps the rod 36 into a secured position. With rod 36 secured, the insert 18 is in position to make the desired size of adobe brick on that part of the gang mold 11.

In the preferred embodiment shown in FIGS. 11–14, the hole 15 would be a ⅜ of an inch threaded female hole. Also, the hole or through aperture 17 would be $\frac{3}{8}$ of an inch or slightly larger than rod 36 to snuggly accommodate the rod 36.

Figure 8:
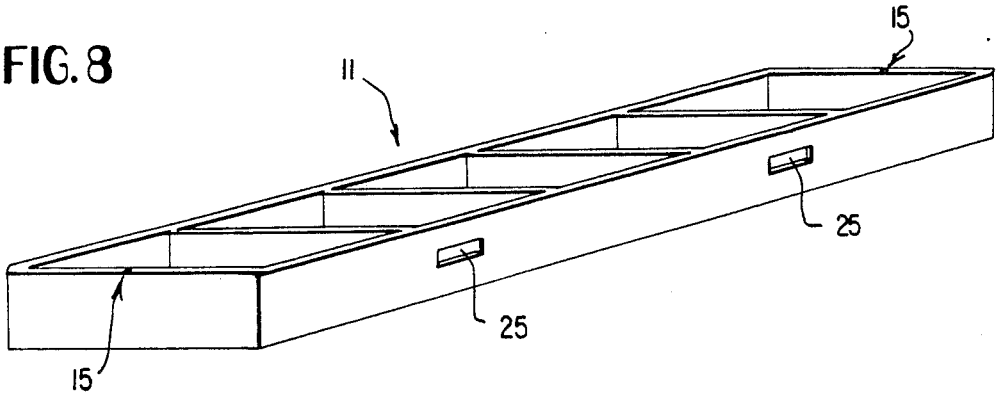
FIG. 8 shows a side view of the gang mold of a preferred embodiment of the invention.

FIG. 8 shows a side view of the gange mold 11. The handholds 25 are used to move the gang mold 11.

Figure 9:
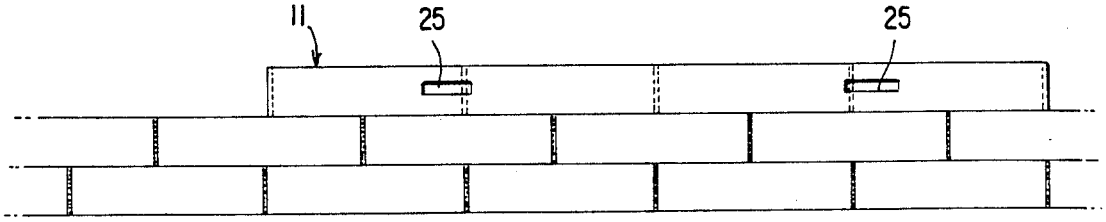
FIG. 9 shows an adobe wall with the gang mold.

FIG. 9 shows the gang mold 11 placed on a wall to cast the next course of bricks. Again, after the gang mold 11 is removed, there exist gaps 51 which are filled when the gang mold 11 is placed to the next course of bricks. The filled gaps are indicated by 52.

Figure 10:
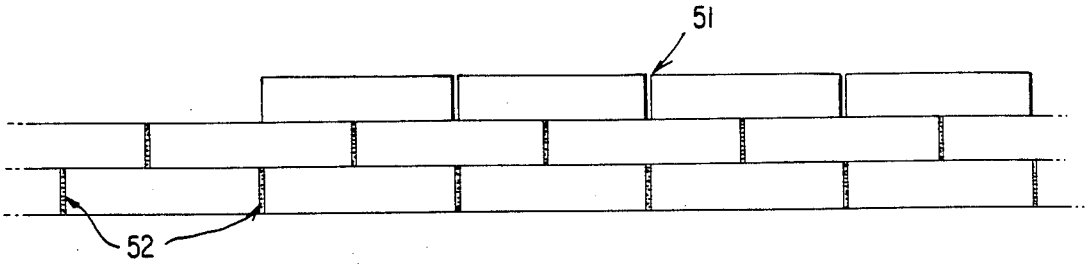
FIG. 10 shows an adobe wall made with the gang mold.

FIG. 10 shows the adobe wall after removal of the gang mold 11. The tap 51 is filled when the next course of bricks are in place as indicated by filled gap 52.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be reverted to, falling within the scope of the invention. For example, the form 10 or gang mold 11 could be constructed of aluminum, fiberglass, or wood. The rod 36 could be connected to the insert 18 by welding if metal, by screws if wood, or by fusing if extruded plastic is used. Also, the frustrum shaped member 34 could be welded to the telescoping sleeve 35. Therefore, changes and modifications in the specifically described embodiments can be carried out without departing from the scope of the invention which is intended to be limited only by the scope of the appended claims.

What is claimed:

1. An apparatus for making an adobe brick structure comprising:

a rectangular shaped device having an open top and bottom defining a hollow volume for receiving adobe mud including two pairs of parallel planar sides, each said side having an inside face and an outside face;

a first planar edge, extending around the perimeter of said rectangular shaped device, for defining a top edge of said rectangular shaped device;

a second planar edge, extending around the perimeter of said rectangular shaped device, for defining a bottom edge of said rectangular shaped device;

a handhold means, forming a cavity on the outside face of each of said planar sides, for maneuvering said rectangular shaped device;

means for adjusting said rectangular shaped device so that said volume is capable of selectively receiving different amounts of adobe mud to form different size adobe bricks; and means for stabilizing said rectangular shaped device being perpendicularly mounted to said device relative to a plane defined by said second planar edge.

2. The apparatus of claim 1 wherein each of said planar sides further comprises:

said first planar edge having a first through aperture, said first through aperture extending from said first planar edge to the cavity formed by said handhold means; and said second planar edge having a second through aperture, said second through aperture extending from said second planar edge to the cavity formed by said handhold means.

3. The apparatus of claim 2 wherein said first and second through apertures are coaxially aligned.

4. The apparatus of claim 3 wherein said means for stabilizing comprises:

a L-shaped rod, the cross section of said L-shaped rod being less than the cross section of said first and second through apertures so that when said L-shaped rod penetrates said first and second through apertures, said L-shaped rod extends through said apertures and is mounted perpendicularly relative to a plane defined by said second planar edge to provide stability for said rectangular shaped device.

5. The apparatus of claim 1 wherein said means for adjusting comprises:

a T-shaped planar insert being inserted into said rectangular device for adjusting said rectangular shaped device;

a rod shaped member integrally protruding perpendicularly from said T-shaped planar insert;

a sleeve member having an opening at one end and terminating into a base at the other end and being positioned against said inside face of at least one of said pair of planar sides; and a clamping means mounted to said opening for clamping said rod shaped member to said sleeve member so that said T-shaped planar insert is fixedly supported.

6. An apparatus for making an abode brick structure comprising:

a plurality of rectangular shaped devices having an open top and bottom connected together defining a plurality of hollow volumes for receiving adobe mud each device including two pairs of parallel planar sides, each said side has an inside face and an outside face;

a first planar edge, extending around the perimeter of said plurality of rectangular shaped devices, for defining a top edge of said plurality of rectangular shaped devices;

a second planar edge, extending around the perimeter of said plurality of rectangular shaped devices, for defining a bottom edge of said plurality of rectangular shaped devices;

a handhold means, forming a cavity on the outside face of at least one of said planar sides, for maneuvering said plurality of rectangular shaped devices, and means for adjusting said plurality of rectangular shaped devices so that said plurality of hollow volumes are capable of selectively receiving different amounts of adobe mud to form different size adobe bricks.

7. The apparatus of claim 6 wherein at least one of said planar sides further comprises:

said first planar edge having a first through aperture, said first through aperture extending from said first planar edge to the cavity of said handhold means; and said second planar edge having a second through aperture, said second through aperture extending from said second planar edge to the cavity of said handhold.

8. The apparatus of claim 7 wherein said first and second through apertures are coaxially aligned.

9. The apparatus of claim 8 further comprising:

means for stabilizing said plurality of rectangular shaped devices is mounted to one of said sides perpendicularly relative to a plane defined by said second planar edge.

10. The apparatus of claim 9 wherein said means for stabilizing comprises:

a L-shaped rod, the cross section of said L-shaped rod being less than the cross section of said first and second through apertures so that when said L-shaped rod penetrates said first and second through apertures, said L-shaped rod extends through said apertures and is mounted perpendicularly relative to a plane defined by said second planar edge to provide stability for said plurality of rectangular shaped devices.

11. The apparatus of claim 7 wherein said means for adjusting comprises:

a T-shaped planar insert for inserting into at least one of said plurality of rectangular shaped devices for adjusting at least one of said plurality of rectangular shaped devices;

a rod shaped member integrally protruding perpendicularly from said T-shaped planar insert;

a sleeve member having an opening at one end and terminating into a base at the other end and being positioned against said inside face of at least one of said pair of planar sides; and a clamping means mounted to said opening for clamping said rod shaped member to said sleeve member so that said T-shaped planar insert is fixedly supported.

12. The apparatus of claim 6 wherein one of said sides has a side through aperture.

13. The apparatus of claim 12 wherein said means for adjusting comprises:

a T-shaped planar insert being inserted into at least one of said plurality of rectangular shaped device for adjusting at least one of said plurality of rectangular shaped devices;

a rod shaped member integrally protruding perpendicularly from said T-shaped planar insert, wherein the cross section of said rod shaped member being less than the cross section of said side through aperture so that when said rod shaped member penetrates said side through aperture and extends through said aperture, said T-shaped planar insert is parallel to one of said pairs of planar sides; and a clamping means mounted to said first planar edge for clamping said rod shaped member so that said T-shaped insert is fixedly supported.

14. An apparatus for making an abode brick structure comprising:

a plurality of rectangular shaped devices connected together defining a plurality of hollow volumes for receiving adobe mud each device including two pairs of parallel planar sides, each said side has an inside face and an outside face;

a first planar edge, extending around the perimeter of said plurality of rectangular shaped devices, for defining a top edge of said plurality of rectangular shaped devices;

a second planar edge, extending around the perimeter of said plurality of rectangular shaped devices, for defining a bottom edge of said plurality of rectangular shaped devices;

a handhold means, forming a cavity on the outside face of at least one of said planar sides, for maneuvering said plurality of rectangular shaped devices, and means for adjusting said plurality of rectangular shaped devices so that said plurality of hollow volumes are capable of selectively receiving different amounts of adobe mud to form different size adobe bricks; and wherein at least one of said planar sides includes said first planar edge having a first through aperture, said first through aperture extending from said first planar edge to the cavity of said handhold means; and said second planar edge having a second through aperture, said second through aperture extending from said second planar edge to the cavity of said handhold.

* * * * *